US007696143B2

(12) United States Patent
McCue et al.

(10) Patent No.: US 7,696,143 B2
(45) Date of Patent: Apr. 13, 2010

(54) ACIDIC HARD SURFACE CLEANERS

(75) Inventors: Karen Ann McCue, Montvale, NJ (US); Diane Neiman, Montvale, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 70 days.

(21) Appl. No.: 10/525,291

(22) PCT Filed: Aug. 15, 2003

(86) PCT No.: PCT/GB03/03581

§ 371 (c)(1),
(2), (4) Date: Aug. 8, 2005

(87) PCT Pub. No.: WO2004/018599

PCT Pub. Date: Mar. 4, 2004

(65) Prior Publication Data

US 2006/0100128 A1 May 11, 2006

(30) Foreign Application Priority Data

Aug. 22, 2002 (GB) ..... 0219569.1

(51) Int. Cl.
*C11D 1/83* (2006.01)
*C11D 3/16* (2006.01)
*C11D 3/18* (2006.01)

(52) U.S. Cl. ..... 510/238; 510/108; 510/239; 510/405; 510/426; 510/199; 510/477; 510/488

(58) Field of Classification Search ..... 510/238–403, 510/426, 488, 506, 108, 405, 199, 477; 134/40, 134/41, 42
See application file for complete search history.

(56) References Cited

U.S. PATENT DOCUMENTS

| | | | | |
|---|---|---|---|---|
| 2,157,113 | A * | 5/1939 | Carswell | 530/360 |
| 3,312,725 | A * | 4/1967 | Weissenberger | 556/7 |
| 3,370,957 | A * | 2/1968 | Royse et al. | 426/9 |
| 3,833,731 | A * | 9/1974 | Grier et al. | 514/526 |
| 4,104,374 | A * | 8/1978 | Reuther et al. | 514/64 |
| 4,414,128 | A * | 11/1983 | Goffinet | 510/405 |
| 4,863,629 | A | 9/1989 | Osberghaus et al. | 252/162 |
| 5,356,479 | A | 10/1994 | Menke et al. | 134/2 |
| 5,876,738 | A * | 3/1999 | Ohno et al. | 424/404 |
| 6,121,224 | A * | 9/2000 | Fonsny et al. | 510/384 |
| 6,221,823 | B1 * | 4/2001 | Crisanti et al. | 510/238 |
| 6,268,330 | B1 | 7/2001 | Leonard et al. | 510/417 |
| 6,645,929 | B2 * | 11/2003 | Leonard et al. | 510/417 |
| 6,936,579 | B2 * | 8/2005 | Urban | 510/412 |
| 2002/0187918 | A1 * | 12/2002 | Urban | 510/505 |
| 2003/0092597 | A1 * | 5/2003 | Avery et al. | 510/499 |
| 2004/0213750 | A1 * | 10/2004 | Bennett et al. | 424/70.1 |
| 2005/0126503 | A1 * | 6/2005 | Fort, II | 119/72 |

FOREIGN PATENT DOCUMENTS

| | | | |
|---|---|---|---|
| EP | 0378261 | A2 | 7/1990 |
| EP | 0561103 | A1 | 9/1993 |
| EP | 0 994 178 | A | 4/2000 |
| EP | 1 146 111 | A | 10/2001 |
| GB | 2306499 | A | 5/1997 |
| WO | WO 95 33024 | A | 12/1995 |
| WO | WO 02 097020 | A | 12/2002 |
| WO | WO 03 050225 | A | 6/2003 |
| WO | WO 03 080784 | A | 10/2003 |

OTHER PUBLICATIONS

Combined Search and Examination Report from The Patent Office in Great Britain dated Mar. 10, 2003 for Application No. GB 0219569.1.
International Search Report dated Nov. 28, 2003 for Application No. PCT/GB03/03581.

* cited by examiner

*Primary Examiner*—Lorna M Douyon
*Assistant Examiner*—Tri V Nguyen
(74) *Attorney, Agent, or Firm*—Norris McLaughlin & Marcus, PA

(57) ABSTRACT

The present invention is directed to an acidic hard surface treatment composition which provides a cleaning and disinfecting benefit comprising: an acidic constituent which comprises water soluble organic acid; at least one anionic surfactant constituent; at least one nonionic surfactant constituent; at least one organic solvent constituent; optionally one or more further constituents and the balance, water. The compositions exhibit surprising efficacy against various gram positive and gram negative type pathogenic bacteria, as well as against fungi in the absence of known cationic quaternary ammonium compounds known to be effective against pathogenic bacteria, as well as other known-art antimicrobial constituents and bleach are excluded.

8 Claims, No Drawings

ACIDIC HARD SURFACE CLEANERS

This is an application filed under 35 USC 371 of PCT/GB2003/03581.

The present invention relates to lavatory cleaning compositions.

Cleaning compositions are commercially important products and enjoy a wide field of utility in assisting in the removal of dirt and grime from surfaces, especially those characterized as useful with "hard surfaces". Hard surfaces are those which are frequently encountered in lavatories such as lavatory fixtures such as toilets, shower stalls, bathtubs, bidets, sinks, etc., as well as countertops, walls, floors, etc.

The prior art has suggested many compositions which are directed to the cleaning of such hard water and soap scum stains. ("Soap scum" is sometimes referred to as "limescale" in Europe.) Many of these are acidic, aqueous compositions which include one or more detersive surfactants. A limited number of these compositions, in addition to a detersive benefit, also provide a germicidal or sanitizing effect to the hard surfaces being treated, often due to the inclusion of one or more antimicrobial constituents, such as known cationic quaternary ammonium compounds which are known to be effective against gram positive type pathogenic bacteria such as *Staphylococcus aureus*, and/or gram negative type pathogenic bacteria such as *Salmonella choleraesuis* and/or *Pseudomonas aeruginosa*, or other known-art antimicrobial constituents such as non-cationic phenolic based antimicrobials e.g., mono- and poly-alkyl and aromatic halophenols; para-chloro-meta-xylenol;, resorcinol and derivatives thereof; bisphenolic compounds such as 2,2'-methylene bis-(4-chloro-6-bromophenol); halogenated carbanilides such as 3,4,4'-trichlorocarbanilides (Triclocarban); 2-hydroxydiphenyl compounds such as Triclosan; parabens such as propylparaben; pyrithiones; hydantoin compounds such as dimethyidimethylol hydantoin; iodophors and in some cases, bleach. However the inclusion of such antimicrobial constituents is often not without one or more detriments including but not limited to specific formulation limitations, toxicity concerns, and the like.

Accordingly, there is a real and continuing need in the art for improved hard surface treatment compositions which provide a cleaning or disinfecting benefit, (preferably both) and which overcomes one or more of the shortcomings of prior art hard surface cleaning compositions.

According to the invention, there is provided a hard surface treatment compositions which provide a cleaning or disinfecting benefit comprising (preferably consisting essentially of) an acidic constituent which comprises (preferably consists essentially of) an acid selected from the group consisting of: citric acid, sorbic acid, acetic acid, boric acid, formic acid, maleic acid, adipic acid, lactic acid, malic acid, malonic acid, glycolic acid, and mixtures thereof; at least one anionic surfactant constituent; at least one nonionic surfactant constituent; at least one organic solvent constituent; and optionally one or more further constituents selected from coloring agents, fragrances and fragrance solubilizers, viscosity modifying agents, pH adjusting agents and pH buffers including organic and inorganic salts, optical brighteners, opacifying agents, hydrotropes, antifoaming agents, enzymes, anti-spotting agents, anti-oxidants, preservatives, and anti-corrosion agents; and the balance, water.

According to preferred embodiments of the invention, the inventors have surprisingly found that the inclusion of modest amounts of the specific water soluble organic acids in conjunction with the specific surfactants in the largely aqueous compositions surprisingly provide a satisfactory antimicrobial effect to the hard surfaces treated with the largely aqueous compositions of the invention. This is particularly surprising as such preferred embodiments of the inventive compositions specifically exclude known cationic quaternary ammonium compounds which are known to be effective against gram positive and/or gram negative pathogenic bacteria, as well as excluding other known-art antimicrobial constituents such as non-cationic phenolic based antimicrobials e.g., mono- and poly-alkyl and aromatic halophenols; para-chloro-meta-xylenol; resorcinol and derivatives thereof; bisphenolic compounds such as 2,2'-methylene bis-(4-chloro-6-bromophenol); halogenated carbanilides such as 3,4,4'-trichlorocarbanilides (Triclocarban); 2-hydroxydiphenyl compounds such as Triclosan; parabens such as propylparaben; pyrithiones; hydantoin compounds such as dimethyidimethylol hydantoin; iodophors and also, bleach. The inventive compositions are also expected to have a low potential for irritation as well as low toxicity levels due to the absence of these aforesaid known cationic quaternary ammonium compounds and other known-art antimicrobial constituents.

The inventive compositions necessarily include an organic acid constituent selected from the group consisting of: citric acid, sorbic acid, acetic acid, boric acid, formic acid, maleic acid, adipic acid, lactic acid, malic acid, malonic acid, glycolic acid, and mixtures thereof. Each of these acids are water soluble, and comprises as least one carboxyl group (—COOH) in its structure. The organic acid may be present in any effective amount, but desirably is not present in amounts of more than about 10% wt. based on the total weight of the compositions (generally from about 0.1 to about 10% wt.). Further, the amount of acid present in the composition, keeping in mind any optional ingredients that may be present, should be in an amount such that the pH of the composition is less than 6, preferably from about 5.0 to about 1.0, more preferably from about 4.0 to about 1.0, and even more preferably from about 3.0 to about 1.0.

A further essential constituent of the present inventive compositions is an anionic surfactant constituent which comprises one or more anionic surfactants. Suitable anionic surfactants include, for example, alkali metal salts, ammonium salts, amine salts, or aminoalcohol salts of one or more of the following compounds (linear and secondary): alcohol sulfates and sulfonates, alcohol phosphates and phosphonates, alkyl sulfates, alkyl ether sulfates, sulfate esters of an alkylphenoxy polyoxyethylene ethanol, alkyl monoglyceride sulfates, alkyl sulfonates, olefin sulfonates, paraffin sulfonates, beta-alkoxy alkane sulfonates, alkylamidoether sulfates, alkylaryl polyether sulfates, monoglyceride sulfates, alkyl ether sulfonates, ethoxylated alkyl sulfonates, alkylaryl sulfonates, alkyl benzene sulfonates, alkylamide sulfonates, alkyl monoglyceride sulfonates, alkyl carboxylates, alkyl sulfoacetates, alkyl ether carboxylates, alkyl alkoxy carboxylates having 1 to 5 moles of ethylene oxide, alkyl sulfosuccinates, alkyl ether sulfosuccinates, alkylamide sulfosuccinates, alkyl sulfosuccinamates, octoxynol or nonoxynol phosphates, alkyl phosphates, alkyl ether phosphates, taurates, N-acyl taurates, fatty taurides, fatty acid amide polyoxyethylene sulfates, isethionates, acyl isethionates, and sarcosinates, acyl sarcosinates, or mixtures thereof. Generally, the alkyl or acyl radical in these various compounds comprise a carbon chain containing 12 to 20 carbon atoms. Examples of the foregoing anionic surfactants are available under the following tradenames: RHODAPON, STEPANOL, HOSTAPUR, SURFINE, SANDOPAN, NEODOX, BIOSOFT, and AVANEL.

The anionic surfactant constituent forms from about 0.1 to about 10% by weight. Particularly preferred anionic surfactant constituents and weight percentages thereof are described with reference to one or more of the Examples.

A further essential constituent of the present inventive compositions is a nonionic surfactant constituent which comprises one or more nonionic surfactants. Nonlimiting examples of suitable nonionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

(2) The condensation products of aliphatic alcohols with from about 1 to about 60 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5 (also available as Teric G9A5), which is described in product literature from Sasol as a $C_{8-10}$ having an average molecular weight of 356, an ethylene oxide content of about 4.85 moles (about 60 wt. %), and an HLB of about 12; Alfonic® 810-2, which is described in product literature from Sasol as a $C_{8-10}$ having an average molecular weight of 242, an ethylene oxide content of about 2.1 moles (about 40 wt. %), and an HLB of about 12; and Alfonic® 610-3.5, which is described in product literature from Sasol as having an average molecular weight of 276, an ethylene oxide content of about 3.1 moles (about 50 wt. %), and an HLB of 10. Product literature from Sasol also identifies that the numbers in the alcohol ethoxylate name designate the carbon chain length (numbers before the hyphen) and the average moles of ethylene oxide (numbers after the hyphen) in the product.

Further examples of useful nonionic surfactants include alcohol ethoxylates including $C_{10}$ oxo-alcohol ethoxylates available from BASF under the Lutensol ON tradename. They are available in grades containing from about 3 to about 11 moles of ethylene oxide (available under the names Lutensol ON 30; Lutensol ON 50; Lutensol ON 60; Lutensol ON 65; Lutensol ON 66; Lutensol ON 70; Lutensol ON 80; and Lutensol ON 110). Yet further examples of ethoxylated alcohols include the Neodol® 91 series non-ionic surfactants available from Shell Chemical Company which are described as $C_9$-$C_{11}$ ethoxylated alcohols. The Neodol® 91 series nonionic surfactants of interest include Neodol 91-2.5, Neodol 91-6, and Neodol 91-8. Neodol 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Still further examples of ethoxylated alcohols include the Rhodasurf® DA series nonionic surfactants available from Rhodia which are described to be branched isodecyl alcohol ethoxylates. Rhodasurf DA-530 has been described as having 4 moles of ethoxylation and an HLB of 10.5; Rhodasurf DA-630 has been described as having 6 moles of ethoxylation with an HLB of 12.5; and Rhodasurf DA-639 is a 90% solution of DA-630.

Further examples of ethoxylated alcohols include those from Tomah Products (Milton, Wis.) under the Tomadol tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear C9/C10/C11 and n is 2.5, 6, or 8; 1-3; 1-5; 1-7; 1-73B; 1-9;—where R is linear C11 and n is 3, 5, 7 or 9; 23-1; 23-3; 23-5, 23-6.5—where R is linear C12/C13 and n is 1, 3, 5, or 6.5; 25-3; 25-7; 25-9; 25-12—where R is linear C12/C13 C14/C15 and n is 3, 7, 9, or 12; and 45-7; 45-13—where R is linear C14/C15 and n is 7 or 13.

Other examples of nonionic surfactants include primary and secondary linear and branched alcohol ethoxylates, such as those based on $C_6$-$C_{18}$ alcohols which further include an average of from 2 to 80 moles of ethoxylation per mol of alcohol. These examples include the Genapol UD series from Clariant, described as tradenames Genapol UD 030, $C_{11}$-Oxo-alcohol polyglycol ether with 3 EO; Genapol UD, 050 $C_{11}$-Oxo-alcohol polyglycol ether with 5 EO; Genapol UD 070, $C_{11}$-Oxo-alcohol polyglycol ether with 7 EO; Genapol UD 080, $C_{11}$-Oxo-alcohol polyglycol ether with 8 EO; Genapol UD 088, $C_{11}$-Oxo-alcohol polyglycol ether with 8 EO; and Genapol UD 110, $C_{11}$-Oxo-alcohol polyglycol ether with 11 EO.

Other examples of useful nonionic surfactants include those having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename, available from Clariant, Charlotte, N.C., include the 26-L series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N. From product literature, the single number following the "L" corresponds to the average degree of ethoxylation (numbers between 1 and 5) and the two digit number following the letter "L" corresponds to the cloud point in ° C. of a 1.0 wt. % solution in water.

(3) Alkoxy block copolymers, and in particular, compounds based on ethoxy/propoxy block copolymers. Polymeric alkylene oxide block copolymers include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO)_y(EO)_z\text{—}H \quad (A)$$

where EO represents ethylene oxide,

PO represents propylene oxide, y equals at least 15, $(EO)_{x+y}$ equals 20 to 50% of the total weight of said compounds, and, the total molecular weight is preferably in the range of about 2000 to 15,000. These surfactants are available under the PLURONIC tradename from BASF or Emulgen from Kao.

Another group of nonionic surfactants appropriate for use in the new compositions can be represented by the formula (B):

$$R\text{-}(EO,PO)_a(EO,PO)_b\text{—}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO\text{—}(BO)_n(EO)_x\text{—}H \quad (C)$$

wherein R is an alkyl group containing 1 to 20 carbon atoms, n is about 5-15 and x is about 5-15.

Also useful as the nonionic block copolymer surfactants, which also include polymeric butoxy groups, are those which may be represented by the following formula (D):

$$HO\text{-}(EO)_x(BO)_n(EO)_y\text{—}H \quad (D)$$

wherein n is about 5-15, preferably about 15, x is about 5-15, preferably about 15, and y is about 5-15, preferably about 15.

Still further useful nonionic block copolymer surfactants include ethoxylated derivatives of propoxylated ethylene diamine, which may be represented by the following formula:

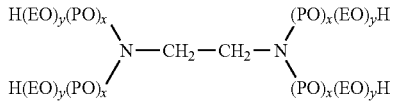

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

The nonionic surfactant is present in the compositions of the present invention in an amount of from about 0.1 to about 10% by weight. Particularly preferred nonionic surfactant is constituents and weight percentages are described with reference to one or more of the Examples.

A further necessary constituent of the inventive compositions is an organic solvent constituent which comprise one or more organic solvents. Examples of organic solvents which may be included in the inventive compositions include those which are at least partially water-miscible such as alcohols (e.g., low molecular weight alcohols, such as, for example, ethanol, propenol, isopropanol, and the like), glycols (such as, for example, ethylene glycol, propylene glycol, hexylene glycol, and the like), water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethylene glycol or propylene glycol (e.g. propylene glycol monomethyl ether acetate), and mixtures thereof. Glycol ethers having the general structure $R_a$—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units may also be used.

Preferably the organic solvent constituent consists essentially of an alcohol and a water miscible glycol ether to the exclusion of other organic solvents. More preferably the organic solvent constituent consists solely of one or more organic solvents selected from ethanol, dipropylene glycol n-propyl ether and mixtures thereof and most desirably the organic solvent constituent consists solely of a mixture of ethanol and dipropylene glycol n-propyl ether. While not wishing to be bound by the following, the present inventors suspect that this pair of specific solvents may favorably affect the disruption of the cell walls of undesired microorganisms which may facilitate in their demise.

The organic solvent is present in the compositions of the present invention in an amount of from about 0.1 to about 10% by weight, desirably in amounts of 1.0 to about 7.0% by weight, and most desirably from about 1.0 to about 5.0% weight. Particularly preferred organic solvent. constituents and weigh percentages thereof are described with reference to one or more of the Examples.

The compositions are largely aqueous in nature, and comprises as the balance of the composition water in to order to provide to 100% by weight of the compositions of the invention. The water may be tap water, but is preferably distilled and is most preferably deionized water. If the water is tap water, it is preferably substantially free of any undesirable impurities such as organics or inorganics, especially mineral salts which are present in hard water which may thus undesirably interfere with the operation of the constituents present in the aqueous compositions according to the invention.

The composition of the present invention can optionally comprise one or more constituents selected from coloring agents, fragrances and fragrance solubilizers, viscosity modifying agents, other surfactants, pH adjusting agents and pH buffers including organic and inorganic salts, optical brighteners, opacifying agents, hydrotropes, antifoaming agents, enzymes, anti-spotting agents, anti-oxidants, preservatives, and anti-corrosion agents. The use and selection of these constituents is well known to those of ordinary skill in the art. The total amounts of such optional additives is less than about 2% wt. but are desirably significantly less, such as less than about 0.5% wt. based on the total weight of the aqueous cleaning and disinfecting composition being provided herein.

The benefits of the compositions described in this specification include particularly: good removal of hard water stains, good removal of soap scum stains, relatively low toxicity, as well as ease in handling of the composition due to its readily pourable or pumpable characteristic, and when needed, disinfection. Further, when one or more of the optional constituents is added, i.e., fragrance and/or coloring agents, the esthetic and consumer appeal of the product is favorably improved.

The compositions according to the invention are useful in the cleaning and/or disinfecting of hard surfaces, having deposited soil thereon. In such a process, cleaning and disinfecting of such surfaces comprises the step of applying a stain releasing and disinfecting effective amount of a composition as taught herein to such a stained surface. Afterwards, the compositions are optionally but desirably wiped, scrubbed or otherwise physically contacted with the hard surface, and further optionally, may be subsequently rinsed from the surface.

Exemplary hard surfaces which may be treated utilizing the inventive compositions include surfaces composed of refractory materials such as: glazed and unglazed tile, brick, porcelain, ceramics as well as stone including marble, granite, and other stones surfaces; glass; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, curtains, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone. Such hard surfaces described above are to be understood as being recited by way of illustration and not be way of limitation.

The cleaning compositions provided according to the invention can be desirably provided as a ready to use product in a pourable, manually squeezed bottle (deformable bottle), or spray bottle which uses a dip tube and trigger assembly to dispense a liquid In such an application, the consumer generally applies an effective amount of the cleaning composition and within a few moments thereafter, wipes off the treated area with a rag, towel, brush or sponge, usually a disposable paper towel or sponge. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used.

The following examples below illustrate exemplary formulations and preferred formulations of the inventive composition. It is to be understood that these examples are presented by means of illustration only and that further useful formulations fall within the scope of this invention and the claims may be readily produced by one skilled in the art and not deviate from the scope and spirit of the invention. Throughout this specification and in the accompanying claims, weight percents of any constituent are to be understood as the weight percent of the active portion of the referenced constituent, unless otherwise indicated.

EXAMPLES

Preparation of Example Formulations:

Exemplary formulations illustrating certain preferred embodiments of the inventive compositions and described in more detail in Table I below were formulated generally in accordance with the following protocol.

Into a suitably sized vessel, a measured amount of water was provided after which the constituents were added in the following sequence: thickening agents, surfactant, acid and then the remaining constituents. Mixing, which generally lasted from 5 minutes to 120 minutes was maintained until the particular formulation appeared to be homogeneous. The exemplary compositions were readily pourable, and retained well mixed characteristics (i.e., stable mixtures) upon standing. The constituents may be added in any order.

Examples of inventive formulations, including certain particularly preferred formulations are shown in Table 1 below (unless otherwise stated, the components are at 100% active). To each of the compositions was added deionized water in "quantum sufficient" (q.s.) in order to provide 100 parts by weight of the specific composition.

TABLE 1

| Component | Ex. 1 | Ex. 2 | Ex. 3 | Ex. 4 | Ex. 5 | Ex. 6 |
|---|---|---|---|---|---|---|
| Hostapur SAS 60(1) | 4.58 | 5.00 | 5.00 | 2.92 | 5.00 | 2.92 |
| Alfonic 810-4.5(2) | 1.00 | 3.00 | 1.00 | 3.00 | 3.00 | 1.00 |
| ethanol | 1.00 | 1.00 | 1.00 | 1.00 | 3.00 | 1.00 |
| dipropylene glycol n-propyl ether | — | — | 2.00 | 2.00 | 2.00 | — |
| citric acid solution(3) | — | 7.00 | 7.00 | 7.00 | 7.00 | 7.00 |
| citric acid(4) | 3.50 | — | — | — | — | — |
| fragrance(5) | 0.20 | — | — | — | — | — |
| deionized water | q.s. | q.s. | q.s. | q.s. | q.s. | q.s. |

(1)sodium $C_{14-17}$ secondary sulfonate salt; 60% active
(2)$C_{8-10}$ alcohol ethoxylate having an ethylene oxide content of about 4.85 moles
(3)50% active
(4)anhydrous
(5)proprietary composition of its supplier

TABLE 1

| Component | Ex. 7 | Ex. 8 | Ex. 9 | Ex. 10 | Ex. 11 | Ex. 12 |
|---|---|---|---|---|---|---|
| Hostapur SAS 60 | 5.00 | 2.92 | 2.92 | — | 2.92 | — |
| Bio-Soft D40(6) | — | — | — | 4.38 | — | 4.38 |
| Alfonic 810-4.5 | 1.00 | 3.00 | 1.00 | 1.00 | 1.00 | 1.00 |
| ethanol | 3.00 | 3.00 | 3.00 | 1.00 | 1.00 | 1.00 |
| dipropylene glycol n-propyl ether | — | — | 2.00 | — | — | — |
| citric acid solution | 7.00 | 7.00 | 7.00 | — | — | 7.00 |
| lactic acid | — | — | — | 2.50 | 4.38 | — |
| fragrance | — | — | — | 0.25 | 0.25 | 0.25 |
| deionized water | q.s. | q.s. | q.s. | q.s. | q.s. | q.s. |

(6)sodium dodecylbenzene sulfonate; 40% active

TABLE 1

| Component | Ex. 13 | Ex. 14 | Ex. 15 | Ex. 16 | Ex. 17 | Ex. 18 |
|---|---|---|---|---|---|---|
| Hostapur SAS 60 | 2.92 | 2.92 | 5.00 | 2.92 | 5.00 | 2.92 |
| Bio-Soft D40 | — | — | — | — | — | — |

TABLE 1-continued

| Component | Ex. 13 | Ex. 14 | Ex. 15 | Ex. 16 | Ex. 17 | Ex. 18 |
|---|---|---|---|---|---|---|
| Alfonic 810-4.5 | 1.00 | 3.00 | 3.00 | 1.00 | 1.00 | 3.00 |
| ethanol | 1.00 | 1.00 | 3.00 | 1.00 | 3.00 | 3.00 |
| dipropylene glycol n-propyl ether | — | — | — | 2.00 | 2.00 | 2.00 |
| citric acid solution | 4.00 | 7.00 | 7.00 | 7.00 | 7.00 | 7.00 |
| fragrance | 0.25 | 0.25 | 0.25 | 0.25 | 0.25 | 0.25 |
| deionized water | q.s. | q.s. | q.s. | q.s. | q.s. | q.s. |

TABLE 1

| Component | Ex. 19 | Ex. 20 | Ex. 21 | Ex. 22 | Ex. 23 |
|---|---|---|---|---|---|
| Hostapur SAS 60 | 5.00 | 2.92 | 5.00 | 3.55 | 2.08 |
| Alfonic 810-4.5 | 1.00 | 1.00 | 3.00 | 0.75 | 1.88 |
| ethanol | 1.00 | 3.00 | 2.00 | 2.50 | 2.50 |
| dipropylene glycol n-propyl ether | — | — | 2.00 | 1.50 | 1.50 |
| citric acid solution | 7.00 | 7.00 | 7.00 | 7.00 | 7.00 |
| fragrance | 0.25 | 0.25 | 0.25 | 0.20 | 0.20 |
| deionized water | q.s. | q.s. | q.s. | q.s. | q.s. |

TABLE 1

| Component | Ex. 24 | Ex. 25 | Ex. 26 | Ex. 27 |
|---|---|---|---|---|
| Hostapur SAS 60 | 3.55 | 2.08 | 3.55 | 3.55 |
| Alfonic 810-4.5 | 1.88 | 0.75 | 1.88 | 3.00 |
| ethanol | 2.50 | 4.00 | 4.00 | 1.00 |
| dipropylene glycol n-propyl ether | 3.00 | 3.00 | 1.50 | |
| citric acid solution | 7.00 | 7.00 | 7.00 | 7.00 |
| fragrance | 0.20 | 0.20 | 0.20 | 0.20 |
| deionized water | q.s. | q.s. | q.s. | q.s. |

TABLE 1

| Component | Ex. 28 | Ex. 29 | Ex. 30 | Ex. 31 | Ex. 32 |
|---|---|---|---|---|---|
| Hostapur SAS 60 | 5.00 | 5.00 | 5.00 | 5.00 | 4.58 |
| Teric G9A5[(7)] | — | — | — | — | 1.00 |
| Alfonic 810-4.5 | 3.00 | 3.00 | 0.75 | 1.88 | — |
| ethanol | 1.00 | 2.50 | 4.00 | 1.00 | 0.90 |
| dipropylene glycol n-propyl ether | 1.50 | — | — | — | — |
| citric acid solution | 7.00 | 7.00 | 7.00 | 7.00 | 6.30 |
| fragrance | 0.20 | 0.20 | 0.20 | 0.20 | 0.20 |
| deionized water | q.s. | q.s. | q.s. | q.s. | q.s. |

[(7)] $C_{8-10}$ alcohol ethoxylate having an ethylene oxide content of about 4.85 moles The above formulations are expected to have good cleaning properties, including cleaning efficacy of hard surfaces and particularly removal of soap scum from hard surfaces such as lavatory surfaces, kitchen surfaces and the like.

Certain of the compositions were subjected to evaluation of their antimicrobial properties.

A formulation according to Example 1 as described on Table 1 above was evaluated at different pH's in order to evaluate their antimicrobial efficacy against *Staphylococcus aureus* (gram positive type pathogenic bacteria) (ATCC 6538), *Salmonella choleraesuis* (gram negative type pathogenic bacteria) (ATCC 10708), and *Pseudomonas aeruginosa* (ATCC 15442). The testing was performed in accordance with the protocols outlined in AOAC Official Method 961.02 "Germicidal Spray Products as Disinfectants", as described in AOAC Official Methods of Analysis, 16th Ed., (1995).

As is appreciated by the skilled practitioner in the art, the results of the AOAC Germicidal Spray Test indicates the number of test substrates wherein the tested organism remains viable after contact for 10 minutes with a test disinfecting composition/total number of tested substrates (slides) evaluated in accordance with the AOAC Germicidal Spray Test. Thus, a result of "0/10" indicates that of 10 test substrates bearing the test organism and contacted for 10 minutes in a test disinfecting composition, 0 test substrates had viable (live) test organisms at the conclusion of the test. This test is herein interchangeably referred to as the AOAC Germicidal Spray Test. The results of this test is reported on Table 2A.

TABLE 2A

| AOAC Germicidal Spray Test | | |
|---|---|---|
| | Contact Time | |
| challenge organism: | 30 seconds (Pass/Fail) | 5 minutes (Pass/Fail) |
| *Psuedomonas aeruginosa* | 0/60 (Pass) | 0/10 (Pass) |
| *Staphylococcus aureus* | 0/10 (Pass) | 12/60 (Fail)[A] |
| *Salmonella choleraesuis* | 0/10 (Pass) | 0/10 (Pass) |

[A] believed to be an anomalous result, possibly due to inadvertent contamination during testing Such results indicate excellent disinfecting efficacy of the tested composition.

The formulation according to Example 1 as described on Table 1 above was evaluated according to the EPA Virucidal Test Method with the test results reported on the following Table 2B, wherein the number of log reduction achieved against the challenge organism is reported at 30 second and 5 minutes contact time.

TABLE 2B

| EPA Virucidal Test Method | | |
|---|---|---|
| | Contact Time | |
| challenge organism: | 30 seconds | 5 minutes |
| Respiratory Syncytical Virus | 1.0 | 1.0 |
| Rotavirus | 1.93 | 2.5 |
| Herpes Simplex Virus Type I | 4.5 | 4.5 |
| Herpes Simplex Virus Type II | 3.0 | 3.17 |

Good efficacy against these various viruses was achieved.

The formulation according to Example 1 as described on Table 1 above was evaluated according to the European Test Method—EN 1276 with the test results reported on the following Table 2C, indicating whether the tested formulation achieved a "Pass" if the tested formulation achieved a 5-log reduction of the challenge organism, or a "Fail" if this degree of reduction was not attained.

TABLE 2C

| European Test Method - EN 1276 | |
|---|---|
| challenge organism: | score |
| *Escherichia coli* | "pass" |
| *Psuedomonas aeruginosa* | "pass" |
| *Enterococcus hirae* | "pass" |

The formulation according to Example 1 of Table 1 was also subjected to the Quantitative Surface Test according to the prEN 13697 protocol for efficacy against the following challenge organisms: *Staphylococcus aureus* (ATTC 6538); *Escherichia coli* (ATCC 10536) *Enterococcus hirae* (ATCC 10541) and *Pseudomonas aeruginosa* (ATCC 15442). The results of the prEN 13697 test and the number of log reduction for a 5 minute contact time is reported on Table 2D, following.

TABLE 2D

| prEN 13697 | |
|---|---|
| challenge organism: | log reduction |
| *Staphylococcus aureus* | >6.96 |
| *Escherichia coli* | >6.73 |
| *Enterococcus hirae* | >6.32 |
| *Pseudomonas aeruginosa* | >6.20 |

Excellent efficacy against these various challenge organisms was demonstrated.

The formulation according to Example 1 of Table 1 was also evaluated according to the general guidelines of the EPA Hard Surface Mildew-Fungistatic Test in order to evaluate the fungistatic effectiveness of the formulation in the control, prevention or inhibition of fungi which may cause mildew on hard surfaces. The specific challenge organism was *Aspergillus niger* (ATCC 16404) which was cultured on modified Sabourauds Dextrose Agar at 25° C.-30° C. under aerobic conditions.

The test method employed was as follows:

As carriers for the test a series of glazed ceramic tiles (1×1 inch square) were sterilized for 2 hours in a hot air oven at 180° C.

A conidial suspension generally in accordance with the following recited steps. The spores were washed from the surface of a 7-10 day culture of the test fungus (cultured *Aspergillus niger* (ATCC 16404)) using sterile saline/Triton Solution (0.85% saline+0.05% Triton X-100). This suspension was transferred into a sterilized tissue grinder containing 20 sterile glass beads. The piston was reciprocated several times to break up the spore chains, and subsequently the resulting suspension was filtered through a thin layer of sterile cotton gauze to remove hyphal elements. The conidial suspension was standardized to contain five million conidia per mL. One (1.0) mL of the standardized suspension was added to 20.0 mL of sterile Czapek's solution.

The surfaces of 10 tiles were treated by spraying with 3 pumps of the formulation according to Example 1 at a distance of 6-8 inches at 20±2° C. After treatment, the tiles were allowed to stand for 3 minutes. Following the 3 minutes, the tiles were placed in a vertical or near vertical position in order to permit any excess liquid to drain. The treated tiles were placed in sterile petri dishes and allowed to dry for 65 minutes with their lids ajar.

For use as "control" carrier, 10 untreated tiles were placed in sterile petri dishes and placed at 35-37° C. in an incubator for 65 minutes with their lids ajar.

Following the initial drying period recited above, the surfaces of each test tile and control tile were inoculated with 10 μl of the *Aspergillus niger* conidia-Czapek suspension produced previously. The suspension was spread over the entire glazed tile surface without going over the edges using a sterile disposable inoculation loop. The tiles contained in the petri dishes were then returned to a 35-37° C. incubator and thereafter dried for 115-120 minutes.

The tiles were subsequently incubated. Each tile (treated side up) was placed into an individual petri dish containing hardened sterile water agar. The agar plates were incubated at 27° C. and a minimum of 95% relative humidity.

The tiles treated with the composition of Example 1, and control tiles were examined after 7 days of incubation. The presence or absence of fungal growth on tiles was the criterion for determining the effectiveness of the test composition. When no visual growth was evident at the end of the 7 days, a magnified examination was performed. To be considered a valid test, untreated control tiles must be at least 50% covered with fungal growth after the 7 days.

The results of the observation of the tiles are reported in the following Tables 2E and 2F.

TABLE 2E

| "Control" Tiles | Challenge Organism: | Tile number | Visual Evaluation of Control Tiles |
|---|---|---|---|
| untreated control tiles | *Aspergillus niger* | 1 | Growth (50%) |
| | | 2 | Growth (60%) |
| | | 3 | Growth (80%) |
| | | 4 | Growth (80%) |
| | | 5 | Growth (80%) |
| | | 6 | Growth (70%) |
| | | 7 | Growth (70%) |
| | | 8 | Growth (80%) |
| | | 9 | Growth (80%) |
| | | 10 | Growth (80%) |

TABLE 2F

| Tested Tiles | Challenge Organism: | Tile Number | Visual Evaluation of Test Tiles | Magnified Evaluation of Test Tile |
|---|---|---|---|---|
| Test Formulation: Example 1 | *Aspergillus niger* | 1 | No growth (0%) | No growth |
| | | 2 | No growth (0%) | No growth |
| | | 3 | No growth (0%) | No growth |
| | | 4 | No growth (0%) | No growth |
| | | 5 | No growth (0%) | No growth |
| | | 6 | No growth (0%) | No growth |
| | | 7 | No growth (0%) | No growth |
| | | 8 | No growth (0%) | No growth |
| | | 9 | No growth (0%) | No growth |
| | | 10 | No growth (0%) | No growth |

As is evident from the results reported on Table 2F, the formulation according to Example 1 of Table 1 demonstrated no growth of the fungus *Aspergillus niger* on any of the test tiles after 7 days. In sharp contrast, the untreated control tiles demonstrated significant growth of *Aspergillus niger* on at least 50% of the surface of all tiles after 7 days.

Such excellent results against both gram positive and gram negative pathogenic bacteria, as well as excellent efficacy against the initial and subsequent growth of a commonly encountered fungus, *Aspergillus niger* in a composition which specifically excludes known cationic quaternary ammonium compounds which are known to be effective against gram positive and/or gram negative type pathogenic bacteria, as well as excluding other known-art antimicrobial constituents or bleach as recited previously is surprising. Further surprising is the discovery that such broad efficacy is achieved with relatively modest amounts of the specific water soluble organic acids, in conjunction with the preferred surfactants and organic solvents.

The invention claimed is:

1. A hard surface treatment composition which provides a cleaning and disinfecting benefit consisting of:

an acidic constituent which comprises an acid selected from the group consisting of: citric acid, sorbic acid, acetic acid, boric acid, formic acid, maleic acid, adipic acid, lactic acid, malic acid, malonic acid, glycolic acid, and mixtures thereof;

at least one anionic surfactant constituent;

at least one nonionic surfactant constituent;

at least one organic solvent constituent wherein the organic solvent constituent consists solely of ethanol to the exclusion of other organic solvents;

optionally one or more further constituents selected from coloring agents, fragrances and fragrance solubilizers, viscosity modifying agents, pH adjusting agents and pH buffers including organic and inorganic salts, opacifying agents, hydrotropes, antifoaming agents, enzymes, anti-spotting agents, anti-oxidants, preservatives, and anti-corrosion agents;

and the balance, water characterized in that:

cationic quaternary ammonium compounds known to be effective against gram positive and/or gram negative type pathogenic bacteria, other known-art antimicrobial constituents selected from non-cationic phenolic based antimicrobials; para-chloro-meta-xylenol; resorcinol and derivatives thereof; bisphenolic compounds; halogenated carbanilides; 2-hydroxydiphenyl compounds; pyrithiones; hydantoin compounds; iodophors and bleach are excluded.

2. A composition according to claim 1 wherein the acid constituent consists essentially of an acid selected from the group consisting of: citric acid, sorbic acid, acetic acid, boric acid, formic acid, maleic acid, adipic acid, lactic acid, malic acid, malonic acid, glycolic acid, and mixtures thereof.

3. A composition according to claim 1 wherein the pH is from about 1 to about 5.

4. A composition according to claim 3 wherein the pH is from about 1 to 4.

5. A composition according to claim 4 wherein the pH is from about 1 to about 3.

6. A composition according to claim 1 wherein the anionic surfactant is a sulfonate.

7. A composition according to claim 2 wherein the acid constituent consists essentially of an acid selected from the group consisting of: citric acid in the absence of further organic acids, or a mixture of citric acid and lactic acid in the absence of further organic acids.

8. A composition according to claim 1 wherein the composition achieves a log reduction of at least 6 for a 5 minute contact time according to the Quantitative Surface Test of the prEN 13697 protocol against one or more of the challenge organisms: *Staphylococcus aureus* (ATTC 6538); *Escherichia coli* (ATCC 10536) *Enterococcus hirae* (ATCC 10541) and *Pseudomonas aeruginosa* (ATCC 15442).

* * * * *